United States Patent [19]

DiFrank et al.

[11] Patent Number: 4,980,014

[45] Date of Patent: Dec. 25, 1990

[54] APPARATUS FOR APPLYING WRAP-AROUND LABELS TO CONTAINERS

[75] Inventors: Frank J. DiFrank; Richard H. Garnes, both of Toledo, Ohio

[73] Assignee: Owens-Brockway Glass Container Inc., Toledo, Ohio

[21] Appl. No.: 454,486

[22] Filed: Dec. 21, 1989

[51] Int. Cl.[5] ..... B65C 3/00

[52] U.S. Cl. ..... 156/481; 156/488; 156/491; 156/492; 156/521; 156/576; 156/583.3

[58] Field of Search ..... 156/475, 481, 488–491, 156/86, 215, 521, 576, 583.3, DIG. 12, 492

[56] References Cited

U.S. PATENT DOCUMENTS

| | | | |
|---|---|---|---|
| 1,641,045 | 8/1927 | Oslund et al. | 156/566 X |
| 2,656,964 | 10/1953 | Détrez | 156/DIG. 12 X |
| 3,117,904 | 1/1964 | Black | 156/475 |
| 3,206,347 | 9/1965 | Holstein | 156/492 X |
| 3,222,240 | 12/1965 | Carter et al. | 156/486 X |
| 3,899,913 | 8/1975 | Schlosser et al. | 156/215 X |
| 4,832,774 | 5/1989 | DiFrank et al. | 156/566 X |

*Primary Examiner*—Michael W. Ball
*Assistant Examiner*—Mark A. Osele

[57] ABSTRACT

Apparatus and method of applying wrap-around labels to bottles or containers where the label is formed into a complete sleeve with a heat-sealed seam on the container as the containers are moved in a linear path on a conveyor. The bottles and conveyor pass between a continuously moving set of rectractable, electrical heat-seal bars and vacuum label handling heads. The vacuum heads receive individual labels which carry the labels into position opposite a bottle on the conveyor. Vacuum fingers that grip the ends of the label are moved outward on arcuate arms that are pivoted to the head to move the labels about the containers in overlapping relationship. The opposed heat-seal bar is advanced into contact with the overlapped edges of the label and held there for a time sufficient to complete the full height heat seal of the label. The heat bar is contoured to the same shape as the external profile of the container over the label height.

8 Claims, 9 Drawing Sheets

APPARATUS FOR APPLYING WRAP-AROUND LABELS TO CONTAINERS

BACKGROUND OF THE INVENTION

It has become generally accepted in the trade that containers which contain beverage and food products will have a label thereon. Many different systems are presently used to apply the labels to the containers. Some of these systems will apply the label to the container after it has been filled and sealed. Other systems utilize the prelabeled container which is then filled with the product and sealed before distribution.

The present invention is most closely associated with the systems that prelabel the containers before they are filled with a product.

Prior art systems which prelabel containers are known, and one such system which has received considerable acceptance is that disclosed in U.S. Pat. No. 3,802,942, issued to Amberg et al and assigned to the Assignee of the present application. This patent teaches the forming of labels from heat shrinkable plastic that is formed of a film-foam combination plastic that is fed in an oriented sheet form to a vacuum transfer head. The labels are preprinted and cut into lengths as they are received on the transfer head which then delivers the individual labels to a plural sleeve on a mandrel and forms a seam where the ends overlap. Containers are simultaneously processed by being preheated and indexed over the sleeve supporting mandrels. The sleeves are telescopically assembled on the containers and then, together, are transported through a heat shrink tunnel. The plastic sleeve shrinks into snug surface fit with respect to the container.

As can be seen by reading the foregoing U.S. Patent and U.S. Pat. No. 3,767,496, issued Oct. 23, 1973, which discloses the overall process that the apparatus of U.S. Pat. No. 3,802,942 will perform, the forming of a tightly conforming, heat shrunk label on a container, such as a glass bottle, is not a simple task. To prevent wrinkling of the label and consequent distortion in the graphics of the label, it is necessary to apply the label to the bottle in a careful manner. The ends of the label must come into registry so that the label will not seem to be askew. When the label is to be a heat-shrinkable plastic, the ends have to overlap and be firmly sealed together to form a seam that will withstand the stress that is produced when the label shrinks.

When it seemed desirable to make the labeled container without having the label formed into a seamed sleeve before applying it to the container, systems were designed to use the bottle or container itself as the mandrel and then wind the label about the bottle and seal the overlapped ends. This sytem has been disclosed in several recent U.S. patents, including U.S. Pat. No. 4,574,020, issued Mar. 4, 1986, to H. R. Fosnaught and assigned to the Assignee of the present case.

In a still more recent U.S. Pat. No. 4,832,774, issued May 23, 1989, of common Assignee and inventorship with the present application, a system of labeling bottles is disclosed where a label is held by a vacuum head which advances into opposing relationship with a linearly moving bottle. In a timed sequence, the label has its ends pushed about the bottle until they become overlapped, at which time a heater bar engages the overlap to heat seal the label ends together. The bottle with surrounding label is then passed through a heat zone to shrink the label into external conformity with the bottle.

One problem that has arisen with the operation of the above-described apparatus under U.S. Pat. No. 4,832,774 has been the tendency of the overlapped ends of the labels to move out of vertical registry when the machine is operated at high speeds. While a perfectly good label is produced most of the time, the out-of-registry of the overlapping ends can produce a label that does not have a perfect appearance and thus does detract from the aesthetics of the label. This may occur when operating at increased labeling speeds.

The use of vacuum heads to engage labels during transfer of labels to bottles is described in U.S. Pat. No. 3,222,240 to Carter et al, dated Dec. 7, 1965. In this patent the vacuum heads at either side of the central holder are used to maintain tension on the labels during application to avoid wrinkling. The labels must actually slip relative to the heads in order for the labels to be applied to a curved surface without tearing them. This required slippage can result in misalignment of the labels with the bottle axis, but this is not critical since the labels are not complete wrap-around labels and misalignment will not be apparent.

With the foregoing in view, the present invention is one which will overcome the problems found in the prior art systems.

SUMMARY OF THE INVENTION

It is an object of the present invention to provide a labeling system for symmetrical objects, such as containers, where the individual labels are severed from a continuous web of labels and transported in series to a line of containers also moving in series along a linear path. The labels are mechanically held adjacent the containers and have their ends under positive control while being moved about the containers into overlapping relationship, at which time the overlap is heat sealed, all while the containers and labels are following a generally linear path during assembly and sealing of the labels.

It is a further object of the invention to provide a system for handling individually cut labels so as to move the labels, in series, into alignment with the line of moving containers and to hold the center of the labels and the ends while moving the ends outwardly into surrounding relationship with a container and to overlap the ends of the label where a heat-seal bar will engage the "overlap" and remain in contact with the overlap for a time sufficient to form a complete vertical heat seal.

It is a still further object of this invention to seal the overlapping ends of a heat-sealable plastic label that is held about the circumference of the container sidewall, shoulder and heel with an electrically heated bar that has a contour which matches the container sidewall, heel and shoulder so that contact of the bar against the label will assure a full height seal of the label ends in vertical registry so that subsequent heat shrinkage of the label will result in the label closely surrounding the container or bottle shape without a mismatch of the label ends or failure of the vertical heat-sealed seam.

Other and further objects will be apparent from the following detailed description taken in conjunction with the annexed sheets of drawings.

DETAILED DESCRIPTION OF THE PREFERRED EMBODIMENT

Figure 1:
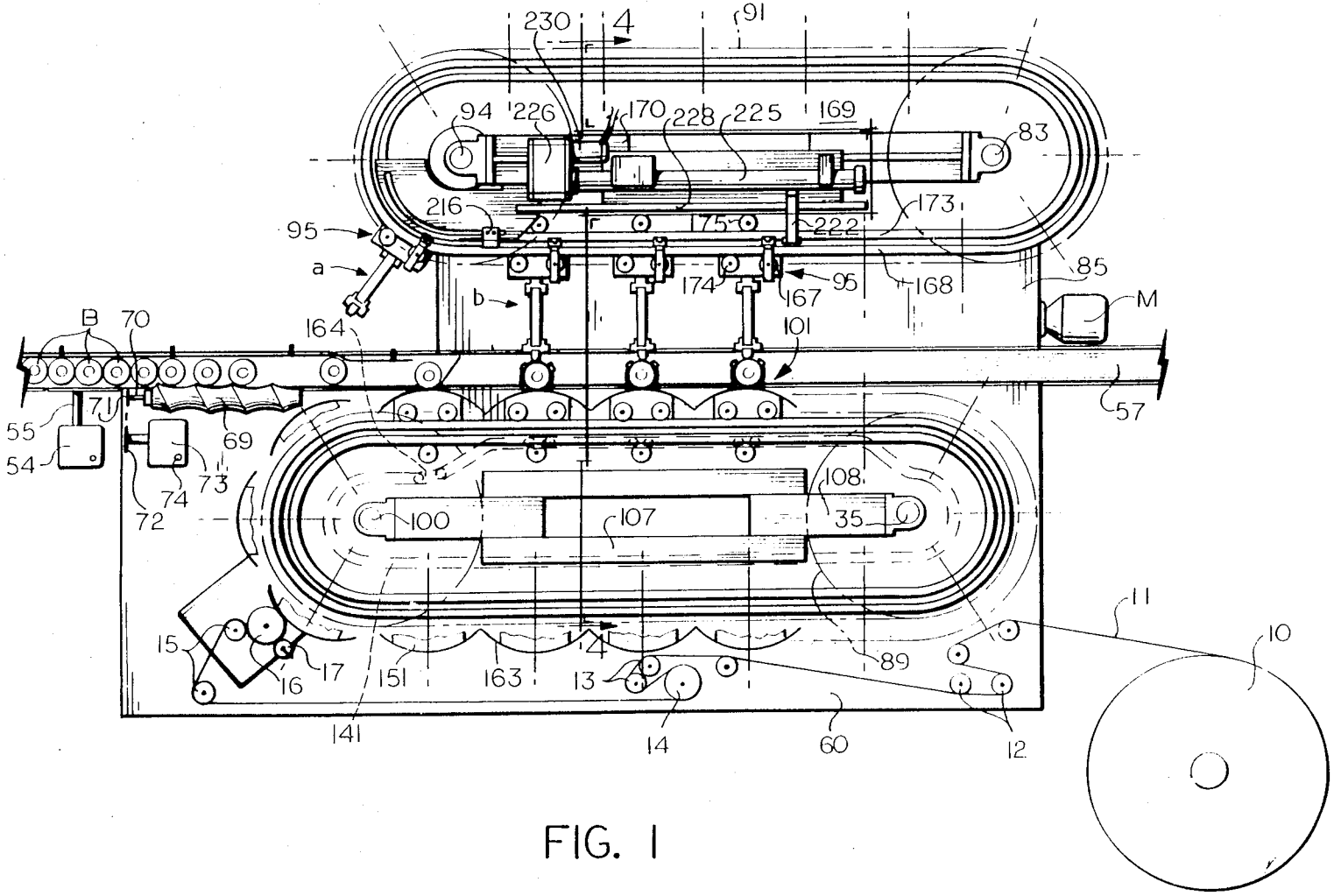
FIG. 1 is a plan view of the label applying machine of the invention.
Figure 3:
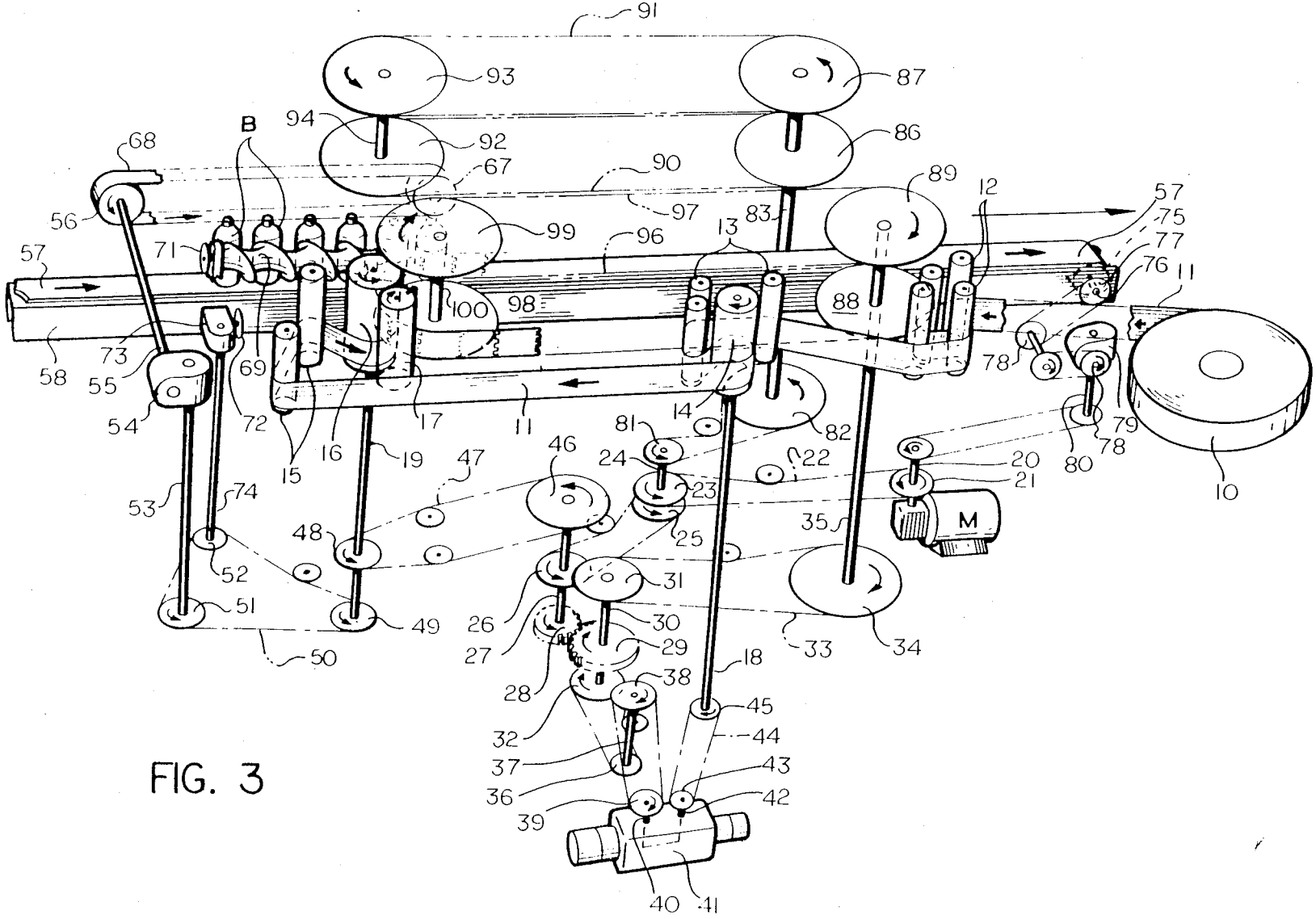
FIG. 3 is a schematic perspective view of the label handling and bottle conveying system of FIG. 1.

The present invention relates to the forming of thermoplastic sleeve labels about the circumference of containers, such as glass bottles, where the labels come in a strip and are severed into label lengths before being applied to the bottle. As best shown in FIGS. 1 and 3, the labels come in a large roll 10 which is supported (not shown) for rotation about a vertical axis. The strip 11 of label material is threaded about a set of guide rollers 12. Another set of guide rollers 13 receive the strip or web of labels and serve to guide the strip about a first drive roll 14. An additional pair of idler rolls 15 serve to guide the web into contact with a vertical roll 16 which serves to transport the loading end of the label strip past a rotating knife 17 that will cut the strip at the precise length of the individual label.

The drive roll 14 is driven by a vertical shaft 18 and the roll 16 is driven by a shaft 19. As can best be seen in FIG. 3, the schematic view of the drive system for the entire machine, a motor M serves as the power source for all of the rotating mechanisms on the machine. The motor M has an output shaft 20 which drives a sprocket 21 which is connected by chain 22 to a sprocket 23 carried on a shaft 24. The shaft 24 carries a second sprocket 25 which is drivingly connected to a sprocket 26 carried by a shaft 27. The shaft 27 drives a spur gear 28 which is in mesh with a spur gear 29 mounted on a shaft 30. The shaft 30 has a pair of sprockets 31 and 32 mounted thereon with the sprocket 31 driving a chain 33 that drives a sprocket 34 mounted on a shaft 35. The sprocket 32 drives a sprocket 36 on a shaft 37 that also carries a sprocket 33. The sprocket 38 drives a sprocket 39 on the input shaft 40 of a variable ratio drive 41. The drive 41 has an output shaft 42 carrying a drive sprocket 43. The drive sprocket 43 is connected by a chain 44 to a sprocket 45 mounted to the shaft 18 for driving the drum 14.

In addition to the sprocket 26, the shaft 27 carries a sprocket 46 which, through a drive chain 47, drives a sprocket 48 on the drive shaft 19 carrying the drum 16.

The shaft 19 also carries a sprocket 49 which drives a chain 50 that is in driving engagement with a pair of sprockets 51 and 52. The sprocket 51 drives an input shaft 53 for a gear box 54 whose output shaft 55 drives a pulley 56 mounted in overlying relationship to an infeed conveyor 57. The conveyor 57 is supported for horizontal movement by an inverted "U" channel 58. A vertical mounting plate 59 is supported from the side of the channel 58 which in turn is supported above a generally horizontal table 60 supported from the floor by vertical legs 61. The rotating shafts, such as 24, 27 and 30, extend from the bottom of the table 60 and are supported by a horizontal platform 62 which is below and generally parallel to the table 60, as shown in FIG. 2.

The pulley 56 is supported at the left end of a horizontal beam 63 that is adjustably mounted to the plate 59 by a threaded adjusting screw 64 which is threaded through a boss 65 on the plate 59 and thrust bearing 66 carried by the beam 63. The beam 63 at its right end, as viewed in FIG. 2, supports a pulley 67. An endless belt 68 extends about the pulleys 56 and 67 and presents a generally horizontal run between the pulleys. The lower surface of the belt 68 is adapted to engage the top of bottles "B" that are positioned on the conveyor 57 and to keep the bottoms of the bottles in contact with the conveyor surface during their entry into the labeling mechanism.

Figure 2:
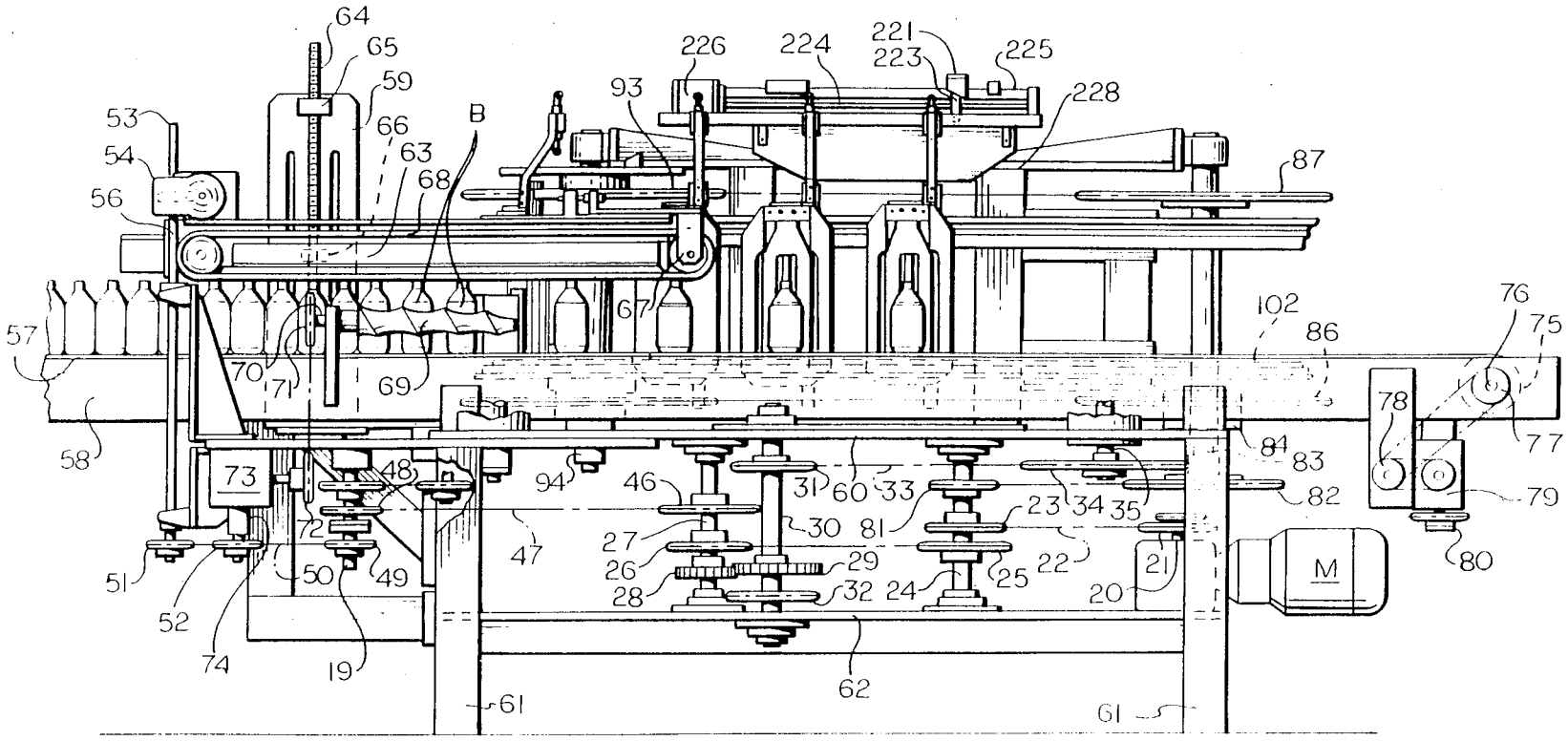
FIG. 2 is a schematic, side elevational view of FIG. 1, taken with the mechanism above the conveyor removed on the near side.

The bottles "B" that are fed to the system from the left, as viewed in FIGS. 1-3, are moved by the conveyor 57 into engagement with an infeed worm 69 mounted for rotation about a horizontal axis 70 and driven by a sprocket wheel 71 that is chain driven from a sprocket 72 connected to the output shaft of a gear box 73 which is driven by a shaft 74 that has the sprocket 52 mounted thereon.

As shown in FIGS. 2 and 3, the conveyor is driven from the right end by a drive pulley or sprocket 75 through the shaft 76 that carries a sprocket 77. The sprocket 77 is chain driven by a sprocket 78 that is driven by the output shaft of a gear box 79. The gear box 79 has an input shaft 80 that is connected by sprocket and chain drive to the output shaft 20 of the motor M. Thus it can be seen that the main bottle conveyor 57 is driven in the direction of the arrow thereon by the same power source that is used to drive the label handling and drive system 14, 16. Therefore, the movements are all controllable by the speed of the motor and the settings of the various gear boxes throughout the system. Obviously, several individual motors could be used; however, they would all have to be in synchronism under control of a single timing motor in order to effect a system where all the elements that are being driven will operate at the correct time.

In addition to driving the conveyor, the motor M drives a sprocket 81 mounted on the shaft 24 with the sprocket 81 driving a drive sprocket 82 mounted to a vertical drive shaft 83. The drive shaft 83 extends through a bearing 84 mounted to a table 85 which extends to the left of table 60 (as viewed in FIG. 4) and overlaps the surface thereof to some extent. The shaft 83 supports a pair of vertically spaced, large diameter sprockets 86 and 87. In a like manner the shaft 35, which extends through the table 60, supports a pair of vertically spaced sprockets 88 and 89.

As schematically illustrated in FIG. 3, the sprockets 86 and 87 drive chains 90 and 91 which extend in an elongated, horizontal path about idler sprockets 92 and 93 mounted on a vertical axle or shaft 94. As explained later in conjunction with FIG. 4, the chains 90 and 91 have sealing bar carriages, generally designated 95, connected thereto and movement of the chains will move the plurality of carriages 95 in an endless path about the shafts 83 and 94. In a like manner, the sprockets 88 and 89 drive endless chains 96 and 97 which are in engagement with idler sprockets 98 and 99 mounted on a vertical shaft 100 at corresponding heights to the drive sprockets 88 and 89. The chains 96 and 97 have vacuum pad carriages, generally designated 101, connected thereto and serve to drive the plurality of carriages 101 in an elongated path about the drive and idler sprockets. The carriages 101 will be described in greater detail in conjunction with FIGS. 4–9 which illustrate these carriages 101 and the manner in which they handle the individual labels.

With reference to FIGS. 4–9, the vacuum carriages 101 are supported by a pair of horizontal plates 102 and 103 that extend between and beyond both shafts 35 and 100. The lower plate 102 is supported above the table 60 by a pair of hollow frame members 104 that hold the plate above the table. The members 104 are joined adjacent their ends into a single frame 105 that serves as the anchor for bearing blocks for the shaft 35. The upper plate 103 is supported by a vertical pedestal 106 (FIGS. 2 and 4) and a pair of hollow frame members 107 which are joined by a single frame member 108 which supports the upper bearing block for the shaft 35 at one end, and the shaft 100 at the opposite end. The frame members are hollow in the interest of providing strength without weight.

The plate 103 has an endless dual rail guide track 109 mounted thereon. The track 109 is actually made up of a pair of parallel rails **109*a* that have a beveled edge which serves to provide a track for a pair of beveled edge wheels 110 and 111 at the front of the carriage at the top and a single wheel 112 at the back of the carriage. Thus the wheels engage both the front and back of the guide track 109. The wheels 110 and 111 are mounted for rotation about vertical axles carried in a member 113 which in turn is carried at the upper end of a vertical slide plate 114**.

Figure 4:
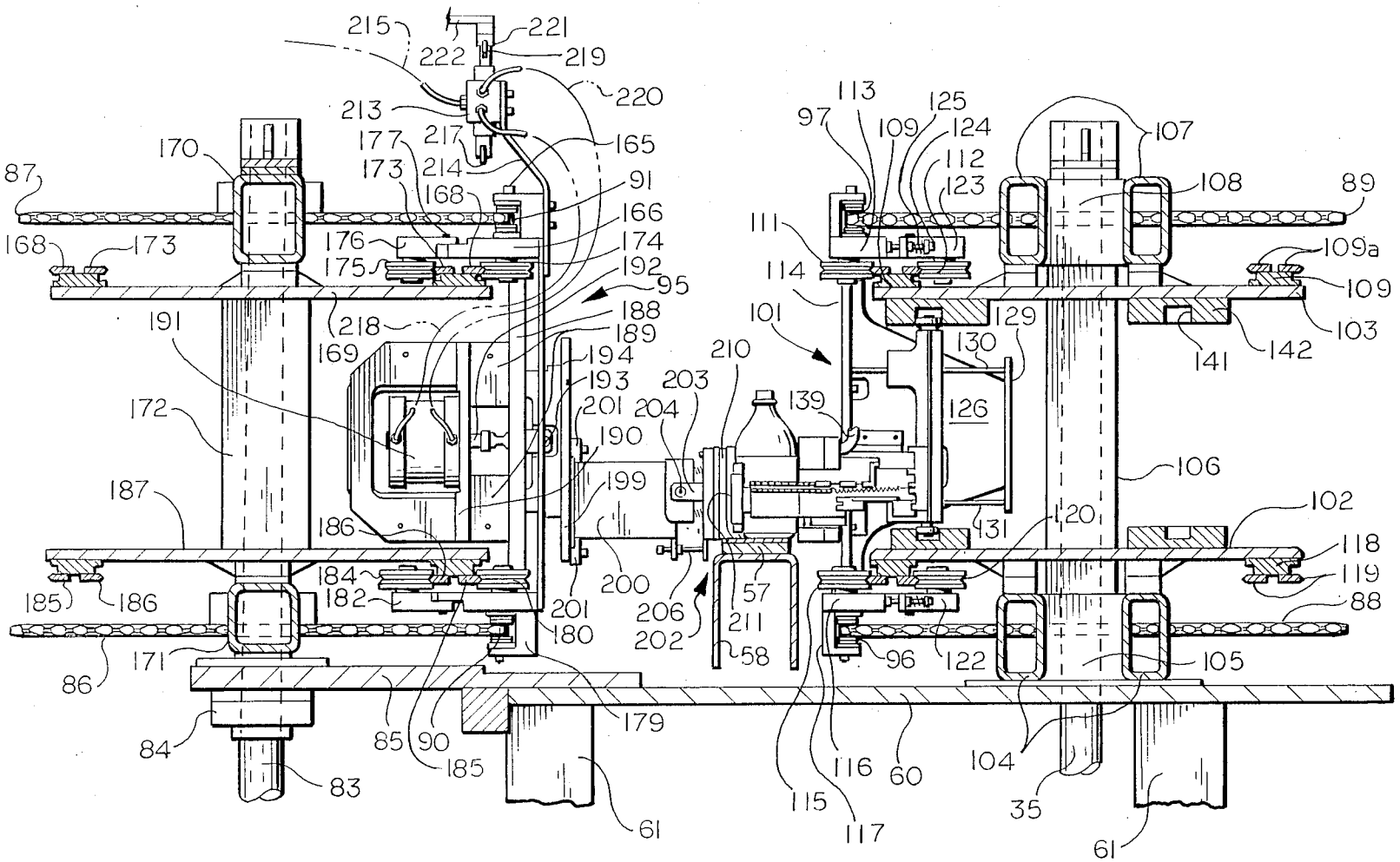
FIG. 4 is a cross-sectional view, on an enlarged scale, taken at line 4—4 of FIG. 1.
Figure 5:
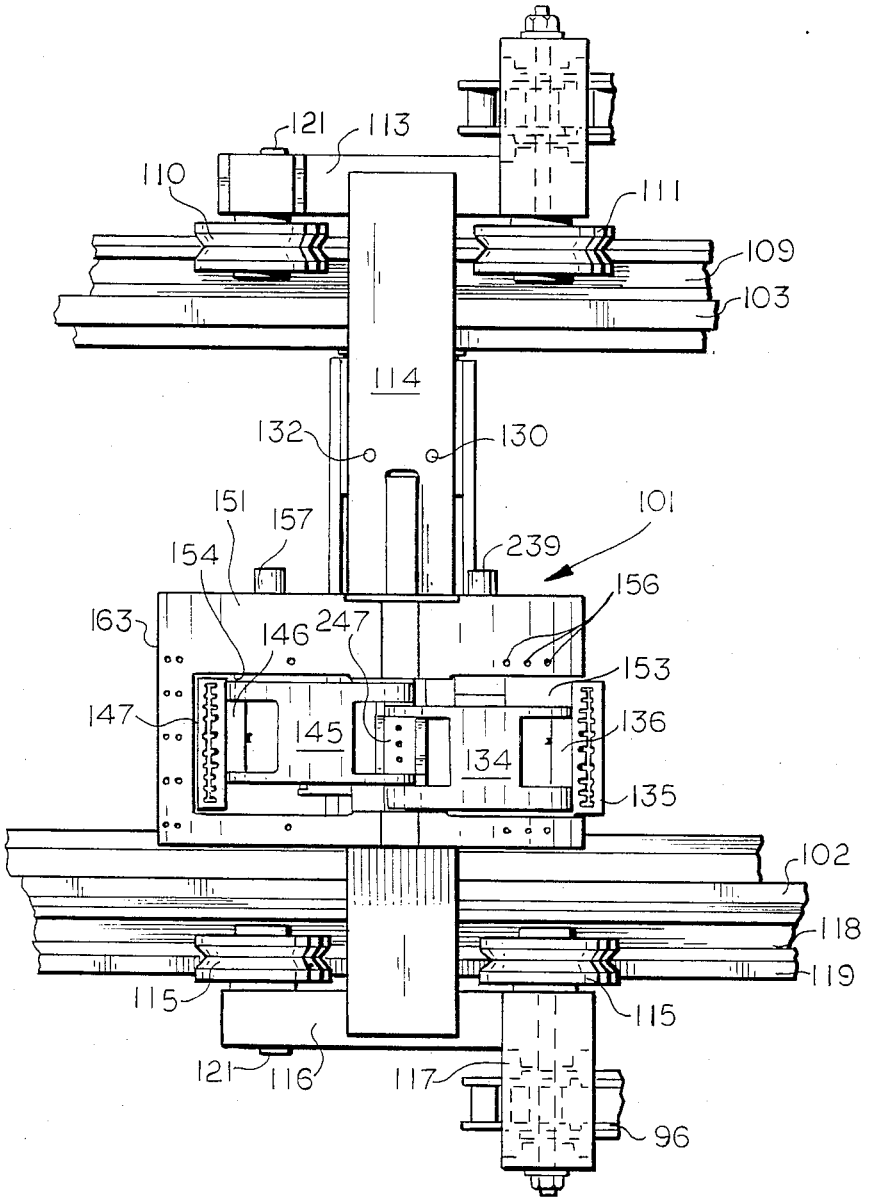
FIG. 5 is a front elevational view of the label transport head of FIG. 4 with the fingers retracted and on an enlarged scale.

At the lower end of the plate 114, there are a pair of beveled edge wheels 115 mounted on a horizontal support member 116. The member 116 carries a downwardly extending boss 117 which is attached to the lower drive chain 96. The lower horizontal plate 102, in a manner similar to the plate 103, carries an endless guide track 118 fixed to its under surface. The guide track is made up of a pair of spaced, bevel edged rails 119 which engage the pair of beveled wheels 115 and a single wheel 120. The single wheels 120 and 112 are actually mounted on separate support members 122 and 123 that are pivotally mounted by pivot pins 121 to their respective support members 116 and 113. A threaded bolt 124 (as illustrated in FIG. 4) extends through an opening in the member 123 and threads into the member 113 for adjustment purposes, with a spiral spring 125 positioned between the head of the bolt 124 and the support member 123. In this manner the single wheel 112 is biased in the direction of the guide rail **109*a* and the pair of wheels 110, 111**.

The vertical plate 114 that supports the wheels 110, 111, 112, 115 and 120 supports a vertical web 126 that extends at right angles to the frame 114. In effect, the web 126 extends away from the frame 114 in the vertical gap between the plates 102 and 103. The forward edge of the web 126 is fixed to the back of the plate 114 of the vacuum pad carriages 101. Opposite its connection to the plate 114, the web 126 supports a vertical plate 129. On one side of the web 126 are positioned a pair of vertically spaced, horizontal guide rods 130, 131 with a similar pair of horizontal rods 132 and 133 mounted on the opposite side of the web 126. The rods 130–133 extend between the plates 114 and 129 and are fixed thereto The rods 130 and 131 form a horizontal guide for a label, trailing edge, control arm 134.

Figure 6:
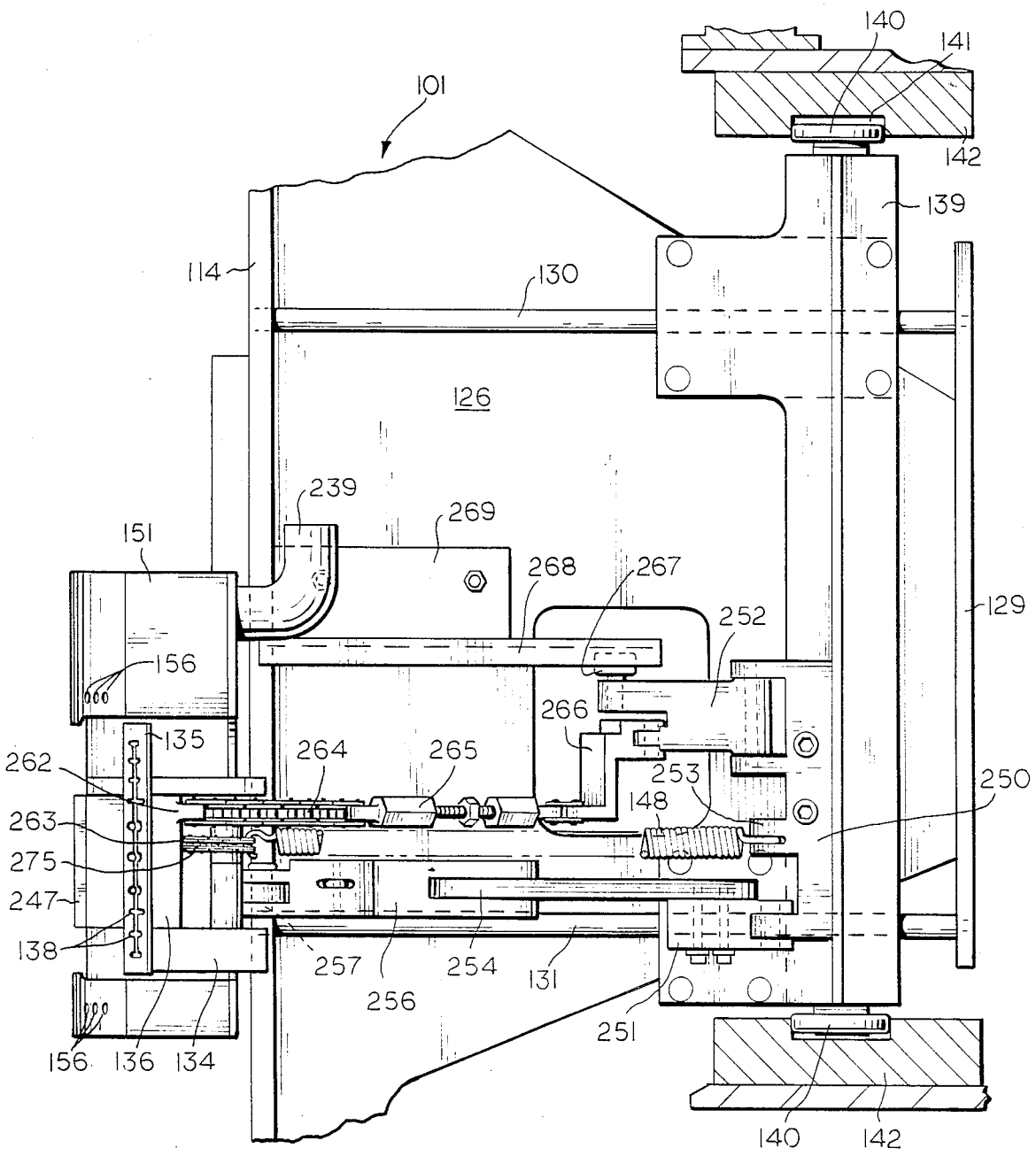
FIG. 6 is a side elevational view of the label transport head similar to FIG. 5, on an enlarged scale.
Figure 7:
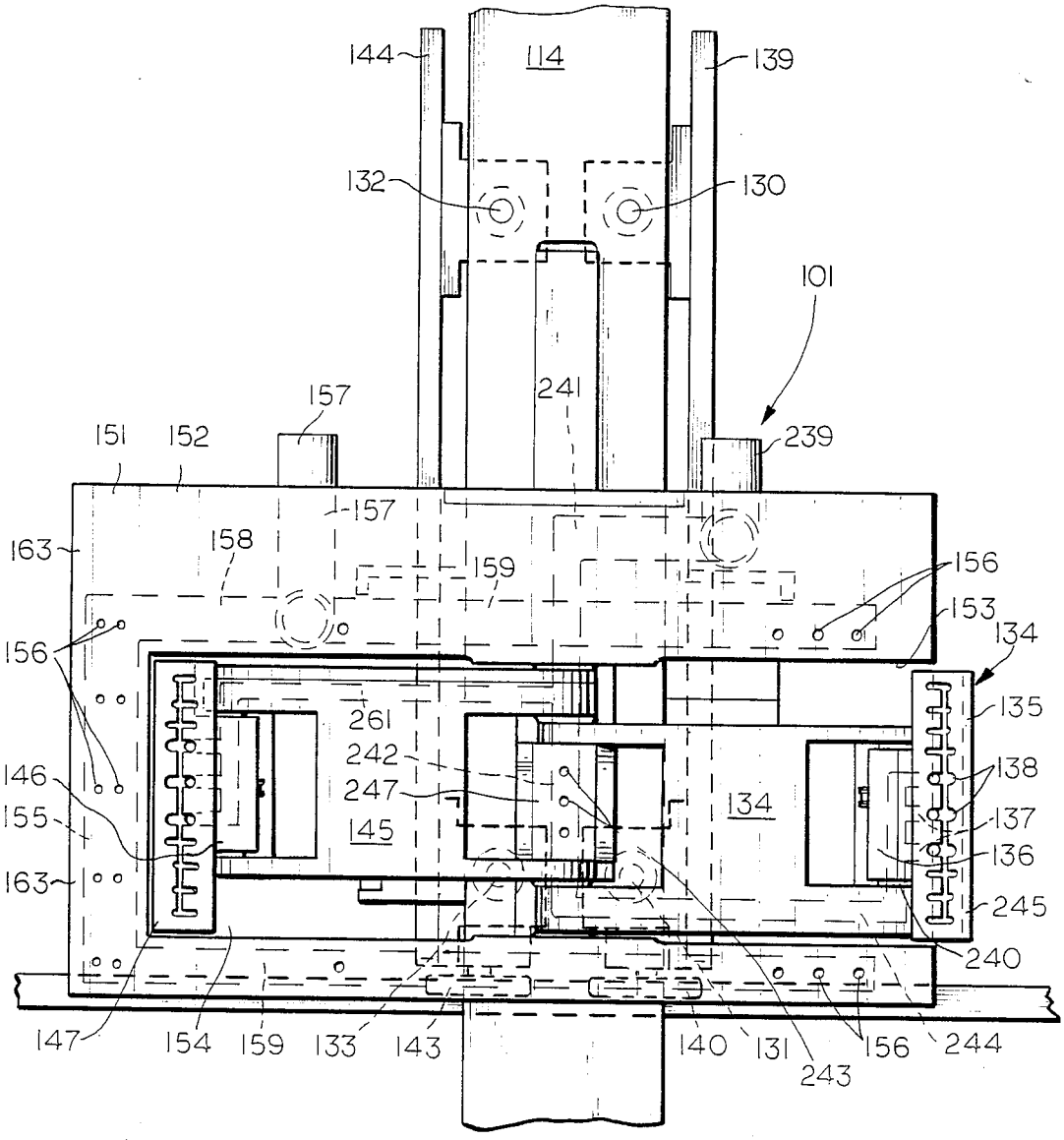
FIG. 7 is a front elevational view of the label transport head of FIG. 7.
Figure 8:
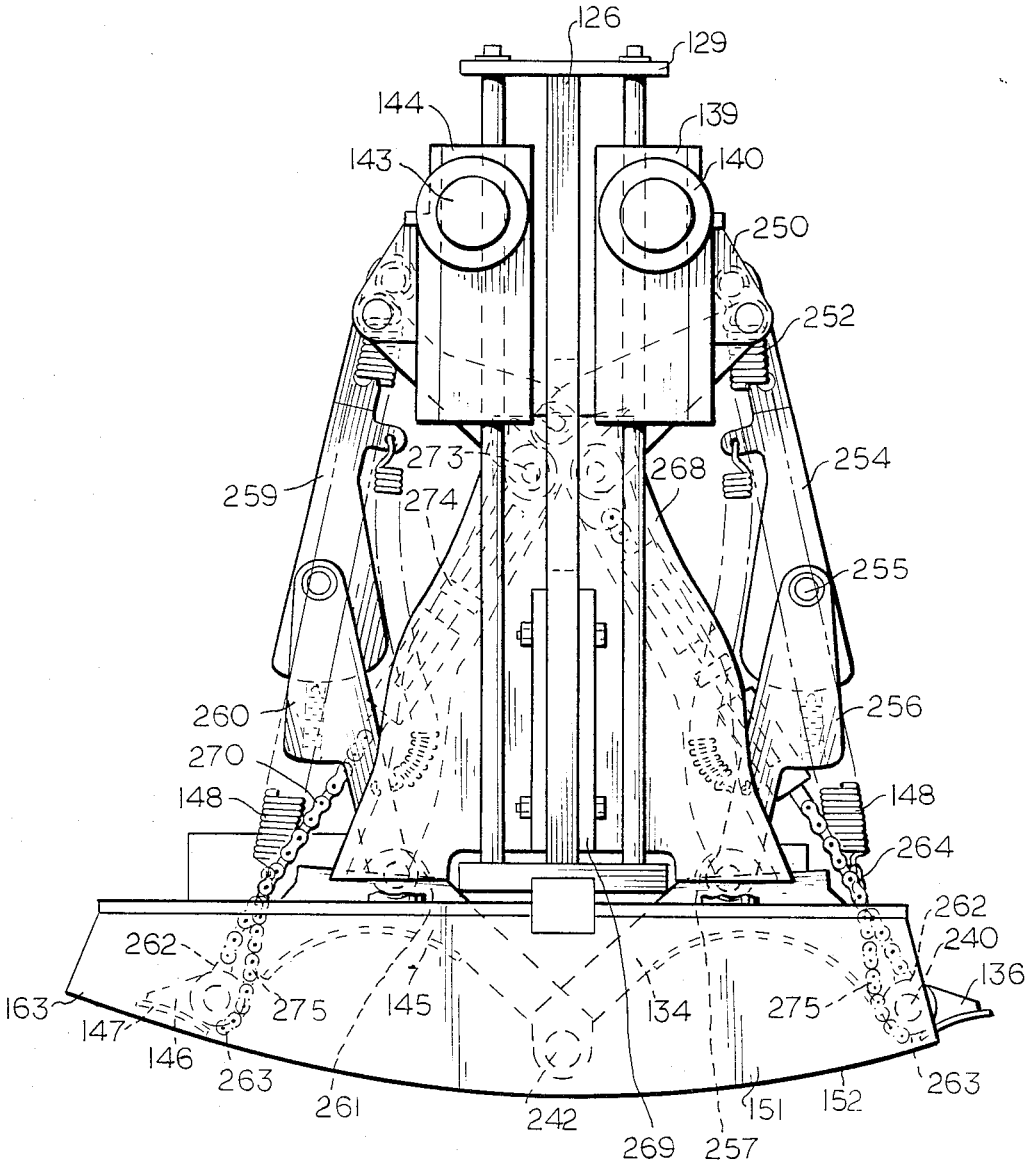
FIG. 8 is a top plan view of the label transport head of FIG. 5 on the same scale as FIG. 6.

The control arm 134 is in the form of an arcuate shaped casting with a bifurcated end that pivotally supports a vacuum pad 135 on the end of a finger 136. The pad 135 is fixed to the outer surface of the finger 136 through which vacuum passages 137 extend to the surface thereof in underlying relation to complimentary recesses 138 in the pad 135 (FIG. 7). As best shown in FIGS. 6 and 7, a vacuum line or pipe 139 is connected to a source of vacuum (not shown). The line 239 opens into a passage 241 in an arcuate faced body member or casting 151 formed with an arcuate face 152 (see FIG. 8). The finger 136 is pivotally mounted on a vertical tube 240 for pivotal movement thereabout. The tube is supported within an opening formed in the arm 134. The vacuum passage 241 in the member 151 extends to the center of the member or casting and meets a vertical passage 241 that extends down through the hollow axis of a hinge pin 242. The pin 242 is provided with three vertically spaced radial openings 243 in the side thereof facing the front of the body member 151 at the center thereof. The openings 243 extend through a block 247 whose surface is generally parallel to the surface 152 of the member 151. With this configuration a label that is transferred to the surface of the member 151 will be held by the vacuum in passage 241 and openings 243. In addition, the passage 241 has a branch passage 244 at the lower end of the pin 242 that extends to a vertical passage that connects to a passage 245 in a vertical pivot pin 242 The pin 242 pivotally supports the finger 135 and its passage 245 connects to the vacuum passages 137.

A vertical arm 139 (FIGS. 6 and 7) is mounted for horizontal movement on the lower guide rod 131. The arm 139 also has an opening through which the upper guide rod 130 extends. The arm 139 has a cam-follower roller 140 connected to both its upper and lower ends with the rollers extending into a cam track 141 of a horizontal cam plate 142. The upper section of cam plate 142 is fixed to the underside of the plate 103. The full cam track 141 is schematically illustrated in FIG. 1 and forms an endless track within which the rollers 140 and second rollers 143 are positioned. The rollers 143 are connected to the upper and lower ends of an arm 144 which is a mirror image of the arm 139. The arm 144 is on the other side of the web 126 and controls the movement of an arcuate shaped control arm 145 which is functionally identical to arm 134. The arm 145 supports a casting 146 to which is mounted a vacuum pad 147. The casting 146 is pivotally mounted on a vertical tube and biased toward the web 126 as is the other pad 135 of the finger 136. The fingers 136 and 146 are mounted to pivot within their arms but are spring biased by springs 148 in the direction of the web 126.

Fixed to the outer face of the vertical plate 114 is an aluminum casting 151 which is formed with an arcuate face 152. The casting 151 is formed with a pair of generally rectangular openings 153 and 154 that extend therethrough. The finger 146 of control arm 145, when in the retracted position as shown in FIGS. 5–8, is positioned within the opening 153 in the casting 151. The casting 151 is provided with a vertical passage 155 which serves as a manifold passage connected to a plurality of vacuum ports 156 that extend through the arcuate face 152 thereof. As best illustrated in FIG. 7, the face 152 of the casting 151 is provided with a plurality of vacuum ports 156. The ports 156 are connected to a vacuum line 157 by branch passages 155, 158 and 159. All of the ports 156 will receive vacuum when line 157 is connected to a vacuum source (not shown). As, viewed in FIGS. 1 and 5, the plurality of castings 151 are presented to the label bearing transfer roll 16, such that the leading edge 163 will first engage the surface of the label. The vacuum through line 157 will be connected to the vertical manifolds at the left resulting in the label adhering to the surface of the casting. As the casting 151 of FIG. 1 continues to be moved in the direction of the arrow, the label will be transferred to the arcuate surface of the casting and the knife 17 will sever the label at the proper time to give a label of predetermined length corresponding to the length of the arcuate surface 152 of the casting 151.

It can be seen that the label will be adhered or held by the vacuum ports to the surface 152. The individual labels will be transported by the castings from the vertical, transfer roll 16 to a position where the label will be applied about the circumference of a container on the conveyor 57 by the manipulation of the fingers 136 and 146. As can best be seen in FIG. 1, the label carrying castings 151 will move in a clockwise direction about the axis of shaft 100 being moved by the sprockets 88 and 89 and chains 96 and 97. The vertical arms 139 and 144 will move with the web 126, plate 129 and casting 151, all of which are mounted to the vertical cam actuated slide plate 114. The arms 139 and 144 have their operating rollers 140 and 143 positioned in the cam track 141. As the casting 151 is moved about the center of the shaft 100, the rollers 140 and 143 follow the circular path of the cam track. The cam track 141 departs from this circular path at the location 164 where the roller 143 follows the outward divergent path of the track. This movement, in effect, moves the control arm 145 toward the bottle that has been timed on the conveyor by the worm 69.

It should be remembered that the bottle is being held down against the conveyor surface and therefore is effectively being held in a stable, upright position while moving with the conveyor. The stabilized bottle will have its central axis in alignment with the central manifold block 247 in the casting 151. The vacuum to the line 157 is maintained as the roller 143 starts past the location 164 and begins to move the finger toward the bottle. When this occurs, the pad 147 of the finger 146 will move out of the opening 154 in the casting and move the label outwardly. The finger will be in engagement with the label and be cam controlled as viewed in FIGS. 1, 8 and 9 to, in effect, move the leading edge of the label around the leading side of the bottle.

With particular reference to FIGS. 6–9, the operation of the label wrapping control arms 134 and 145 and their arcuate castings or fingers 136 and 146 will be described in detail.

The vertical arm 139 adjacent its lower end (FIG. 6) is an anchor plate 250 that serves as an anchoring means for three operating members 251, 252 and 253. The member 251 is pivotally connected to the plate 250 and supports a horizontal lever 254. The lever 254 is pivotally connected at 255 to a connecting link 256 that has its other end pivotally pinned to a boss 257 mounted on the control arm 134. The vertical arm 144 at the opposite side of the vertical web 126 carries an anchor plate 258 that is essentially the same as plate 250. Likewise, the plate 258 has a lever 259 pivoted thereto to which a link 260 is pivotally connected. The link 260 in turn is connected to a boss 261 on the arm 145. Forward movement of the arms 139 and 144 caused by the cam followers 140 and 143 will result in the control arms 134 and 145 to move toward each other as they pivot about the hinge pin 242. The control arms 134 and 145 each carry a pivotally connected finger 136, 146 at its outer end with each finger having an internal vacuum chamber that is connected to the vacuum header or pipe 239. The arm 145 has a horizontal passage 261 connected to the vertical passage 241 in the body 151 in the same manner as finger 136. The labels that are carried on the face of the member 151 are engaged by the fingers 136 and 146 and the labels held to the finger pads by the vacuum within the arms.

In addition to the fingers being moved by the movement of the arms to which they are mounted, each finger carries a pair of bosses 262 and 263. The bosses serve as anchoring means for one end of chains. As can be seen in FIG. 6, the boss 263 has a chain 264 connected thereto. The other end of chain 264 is connected to one end of a coupling 265 whose length is adjustable. The other end of the coupling is connected to linkage 266 that in turn is pivotally connected to the operating member 252. The member 252 also supports a cam follower roller 267. The roller 267 is positioned in a downwardly open, horizontal cam track 268. The cam track 268 is fixed to the side of the stationary web 126 by a plate 269.

In a similar manner, the finger 146 is connected through a chain 270 (FIGS. 8 and 9), coupling 271 to an operating member 272 that is coupled to the anchor plate 258. The operating member 272 carries a cam follower roller 273 that is guided in a cam track 274 of the same shape as the track 268. The bosses 263 of the fingers 136 and 146 are connected by chains 275 that have their other ends connected by springs 148 to the boss 253 of the anchor plate 250.

Figure 9:
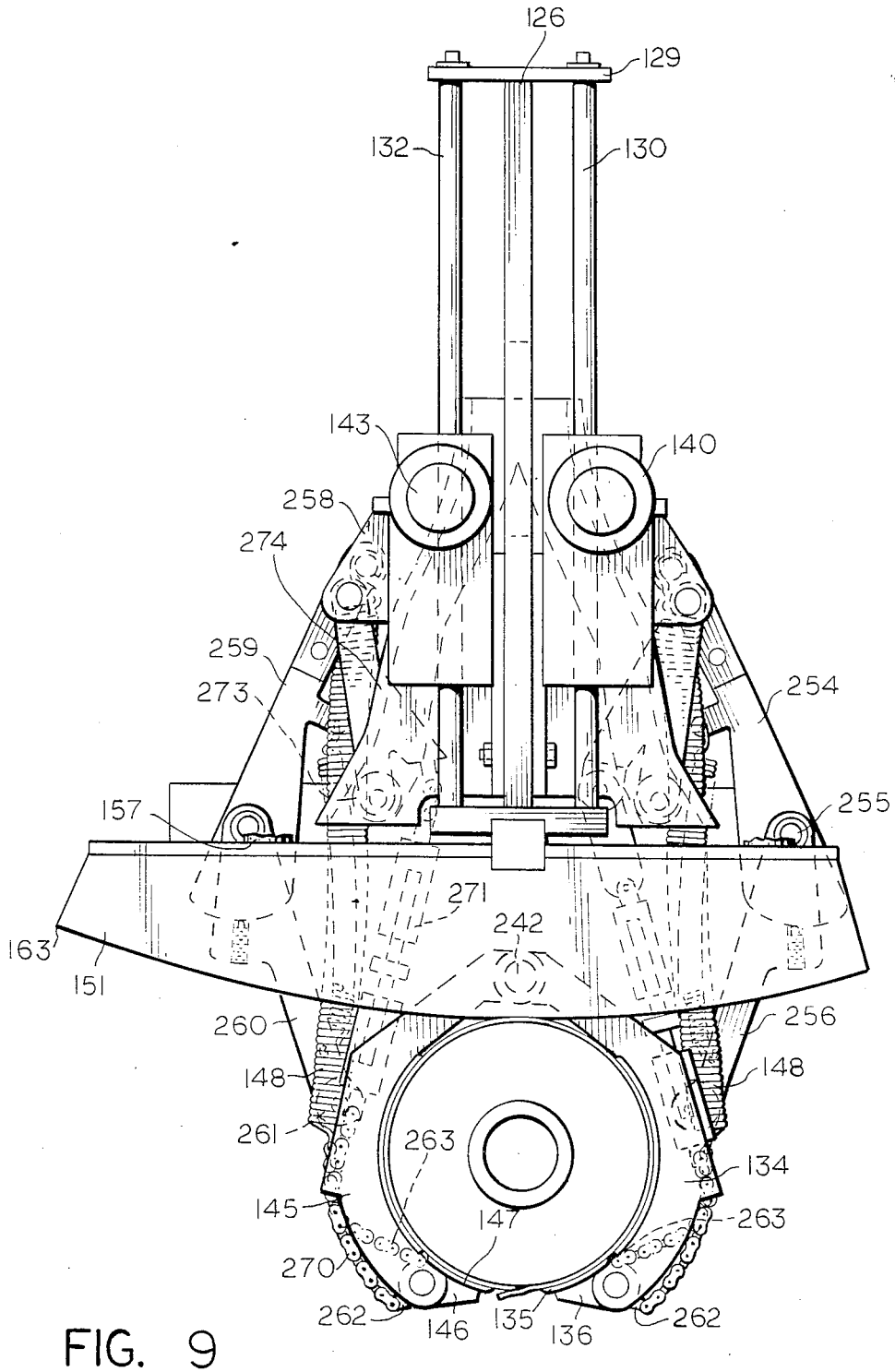
FIG. 9 is a top plan view, similar to FIG. 8, with the vacuum arms extended about a bottle.

With the two chains 264 and 270 connected to the fingers at locations that are nearly 180° removed from the bosses 263 to which the spring biased chains 275 are connected, the angular positions of the fingers as the arms 134 and 145 close about a container are controlled to the degree that the ends of the labels that are supported by the fingers and held thereto against any slippage by vacuum, will cause the label ends to be overlapped, as shown in FIG. 9.

The spring 148 maintains a bias on the fingers in a closing direction while the cam controlled chain 264 resists the closing movement and lets it occur in a controlled manner as the arms 134 and 145 close or move toward each other.

While the arm 145 is moving the leading edge of the label about the leading side of the bottle, the vacuum in the central manifold is maintained so that the label will remain in its vertical and horizontal position, but vacuum in line 157 is shut off. It can be seen that the rollers 140 and 141 will move the fingers 134 and 145 outwardly at slightly different times. This is important since it is important that the ends of the label must overlap so that they can be sealed together to form a complete sleeve about the bottle. By having the leading end or edge of the label moved about the container first, this edge will be in position for the trailing end or edge of the label to overlap it, as seen in FIG. 9.

Thus, from the foregoing description, it can be seen how the bottles are brought from the left in FIG. 1 and are timed by the worm 69 to be released to the moving conveyor in a predetermined sequence. The label material is fed to a transfer head as it is cut into a label length. The transfer head carries the label to a position opposite a bottle on the conveyor and the label is folded around the bottle and held with its free ends in overlapping relationship preparatory to being heat sealed to form a sleeve about the bottle.

As previously described, a plurality of sealing bar carriages 95 are moved into opposing relationship to the bottles on the conveyor 57 and the plurality of vacuum pad carriages 101. As explained in detail, the vacuum pad carriages 101 support the plurality of aluminum castings 151 with the arcuate label supporting faces 152.

Turning now to FIGS. 1–4, the details of the sealing bar carriages 95 will be desribed. All of the carriages are identical in construction and are connected to the driving chains 90 and 91 in essentially the same fashion as the vacuum pad carriages 101 are connected to their drive chains. A vertical shaft 165 connects one link of the upper chain 91 to a horizontal bar 166. The shaft 165 also supports a wheel 167, which is positioned below the bar 166, and is rotatable about the axis of the shaft 165. The wheel has an edge in the form of a V-shaped groove that engages a bevel edged rail 168. The rail 168 is mounted on the upper surface of horizontal plate 169 supported by an upper frame member 170. A lower horizontal frame member 171 supports the upper frame member 160 through a vertical member 172 and the lower frame 171 is supported by the table 85.

Extending parallel to the rail 168 is a rail 173. The rails 168 and 173 constitute a guide rail for the wheel 167 and additional wheels 174 and 175. The wheel 174 is pivotally mounted on the bar 166 and is in engagement with the rail 168 as is the wheel 167. The wheel 175 is pivotally mounted to an arm 176. The arm 176 is pivoted to the bar 166 at 177 and is biased by a spring in the direction of the bar 166 with the effect of maintaining the wheel 175 in engagement with the rail 173.

The lower chain 90 is connected to a bar 179 at the lower end of the carriage 95. The bar 179 supports a pair of wheels 180, only one shown in FIG. 4, and also pivotally supports an arm 182 that is biased in the direction of the bar 179 by a spring. The arm 182 has a wheel 184 mounted thereon. The wheels 180 are in engagement with a rail 185 and the wheel 184 is held in engagement with a rail 186. The rails 185 and 186, which are substantially identical to the rails 168 and 173, are mounted to the underside of a horizontal plate 187 which extends generally parallel to the upper plate 169.

Extending vertically between the upper bar 166 and the lower bar 179 is a mounting plate 188. The plate 188 is welded to a pair of spacers 189 which in turn are welded to a mounting plate 190 for an air motor 191. The motor 191 has a reciprocating piston rod 192 which is connected by a pin 193 to a horizontally movable slide 194. The slide is a generally rectangular plate, laying in a vertical plane. Upper and lower edges of the plate or slide 194 are formed with "V"-shaped edges which engage pairs of "V" edge rollers that are mounted for rotation on axles that are carried on one side of the mount for the motor. Operation of the motor 191 will move the slide 194 to the position shown in FIG. 4. The forward edge of the slide 194 has a vertically positioned slotted bar 199 fixed thereto. The bar 199 supports a horizontally extending arm 200. The arm is clamped in the vertical slot in the bar 199 by a pair of bolted clamp members 201 at the top and bottom.

The arm 200 extends to the right, as viewed in FIG. 4, and supports a sealing head 202 at its end. The head 202 is fixed to a yoke 203 that is mounted on a horizontal pivot pin 204 so that the head 202 may move about the axis of the pin 204. A pair of springs, positioned in recesses in the head and arm, bias the head 202 in an adjusted position determined by the setting of a stop screw 206. The springs will permit some tilting of the head, but of a very limited extent.

The sealing head is composed of a slotted metal holder within which a metal bar is positioned. The bar supports a foam material 210 such as fairly dense foam rubber which has a contoured face that parallels the side wall and heel of the bottle to be labeled. Covering the contoured face of the foam material is an electrical strip heater element 211.

The element 211 is an electrical strip that is flexible and can flex to some extent to accommodate the force of being pressed against the side of a bottle with the overlapped ends of a foam label interposed. One example of the heater strip is termed a silicone rubber/Fiberglass insulated wire element heater sold by Electro-Flex Heat, Inc., of Bloomfield, Conn., U.S.A. The heater comes in strip form and may be cemented to the front of the foam rubber mounting pad 210.

The heater element is pressed against the overlap seam of the label and will heat seal the edges of the labels to each other to form a tight seam. The high temperature silicone rubber will give to some extent so that the force of the heater against the label will be fairly uniform and therefore promote the proper thermal transmission to effect a complete seal. The heater strip has a pair of leads connected thereto and the leads are connected through a slip ring connection to a stationary source of power.

The period of time that the heater is held against the seam is adjustable, automatically, depending upon the speed at which the labels are being applied to the bottles. The temperature of the electrical heater strip is in the range of 450° F. (400°–480° F.) and, since the determinant of a good seal is a time/temperature factor related to the thermal transmission of the heat to the label, it is necessary that the label not be overheated or it may burn; and if not adequately heated, a satisfactory seal will not be formed. In order to control the time that the heat seal strip is held in contact with the label, the motor 191 is tripped in its forward or extending movement by a control valve 213 carried by a bracket 214 mounted to the vertical side of the bar 166. The valve 213 is supplied with air under pressure through a line 215 connected to a source (not shown). As the sealing bar carriage 95 moves from position "a" to position "b" in FIG. 1, a stationary cam 216 trips a lower actuator 217 of the valve 213 to connect air through a line 218 to the end of the motor 191 to cause the piston 192 and arm 200 to extend and bring the heater strip 211 into contact with the overlapped label ends or edges. The valve 213, once it is tripped by the cam 216, will remain in the same position until an upper actuator 219 is tripped. The actuator 219 will connect the source of air to a line 220 to cause the motor to retract its piston rod and the heater strip. The actuator 219 is tripped by a cam 221 that is mounted to an arm 222 that is driven by a follower 223 of a speed screw 224. The speed screw 224 is positioned in a horizontal housing 225 that extends from a gear box 226. The gear box 226 is coupled to an electrical tachometer motor which is electrically connected to a tachometer generator (not shown) that is driven from the main drive motor M.

Thus it can be seen that the heat seal strip will stay in contact with the label until the actuator 219 is tripped by the cam 221. The cam 221 will be moved along the length of the path of travel of the sealing bar carriage to a greater or lesser extent, depending upon the speed of the motor M. When the labeling system of the invention is operating with its 16 heads functioning and labeling 500 bottles per minute, the heat seal bar or strip will be traveling at a fairly rapid rate and the cam 221 will be positioned by the motor near the end of the straight run of the carriages so that the heat seal may be made, but if the machine is slowed down for any reason, the heat seal bar will have to be retracted before it reaches the end of the straight run because it will have been in contact with the label for too long a time and could burn the label. When running slower, the cam 221 will be automatically moved and positioned to the left, as viewed in FIG. 1, so that the heat seal strip will be retracted from the bottle sooner.

The system illustrated in the drawings is one where 16 carriages or heads 95 are moved continuously in a generally oval path with one side of the path being parallel to one side of the oval path that the vacuum pad carriages 101 will be driven. As best seen in FIG. 1, the two adjacent paths are not coextensive, but are of essentially the same length. The path of the vacuum pad carriages 101 starts its straight section parallel to the conveyor 57 before the straight section of the path of the carriages 95. This offset of the two parallel paths is to permit the labels to be assembled to the bottles before the sealing head motor 191 is actuated to move the sealing head into contact with the overlap seam. The head, of course, remains in contact with the bottle for a period of time determined by the speed of movement of the bottles. This adjustable period of holding the sealing head in contact with the label is controlled by a motor driven cam that has its position changed according to the time the label is contacted by the heat seal bar. Alternatively, the motor 191 could be cycled with a predetermined time period, although changes of speed during movement would not be specifically and automatically adjusted as with the present system, but would be effective to keep the sealing bar on the label for a finite period only.

Having described the best mode contemplated for carrying out the labeling system of the invention, it is understood that modifications may be resorted to which will be within the scope of the appended claims.

We claim:

1. Apparatus for applying foam or film plastic labels to a plurality of containers moving on a conveyor, with means for spacing the plurality of containers supported on said conveyor, a plurality of label supporting heads with means for supporting and moving said heads in a continuous path at spaced intervals corresponding to the spacing of containers where said continuous path has a portion that parallels the conveyor at one side thereof, and with means carried by said heads for engaging the ends of a label supported by said head and for moving the ends of the label into surrounding and overlapping relationship with respect to a container on said conveyor, said means for moving the ends of the label comprising a first arcuate arm pivotally mounted at one end of said head adjacent the center thereof, a second arcuate arm mounted to the same pivot as said first arm, said arms being oppositely curved relative to each other so as to closely parallel a container side wall when both are pivoted outward from the front of the head, said arcuate arms being formed with passages extending from the common pivot to the outer ends thereof, a vacuum pad for engaging the ends of a label attached to the outer end of each said first and second arms, each said pad being formed with a series of vertically spaced openings in one face thereof, means pivotally mounting said pads to the ends of said arms, and passage means formed in said common pivot and extending to each opening in each said pad, whereby vacuum is supplied from the pivot in the head to the pad openings.

2. The apparatus of claim 1 further including means connected to each pad for biasing each pad in the direction of a container positioned in front of the head.

3. The apparatus of claim 2 further including means for regulating the movement of each pad from an initial position behind the label on said head to a position where each pad holds the outer ends of the label in overlapping relationship on the side of a container opposite the head.

4. The apparatus of claim 1 further including means connected to each arm for moving the arms outward from a retracted position behind the label on the head to an extended position where the arms embrace a container.

5. The apparatus of claim 1 wherein said means for moving the ends of the label further comprises, a horizontally movable, cam actuated slide plate mounted behind each said head, stationary cam means engaging said cam actuated slide plate for moving said cam actuated slide plate toward and away from said head as said head is moved into position in line with a container, and an adjustable length linkage extending from said cam actuated slide plate to each of said arms for moving said arms about the container.

6. The apparatus of claim 5 further including means connected to each pad for biasing the pads in a direction toward each other.

7. The apparatus of claim 6 further including means connected to each pad for limiting the degree of rotation about their mounting axes to maintain the pads in a controlled closing motion about the container as the cam actuated slide plate is moved.

8. The apparatus of claim 7 wherein said means for limiting the degree of rotation of the pads comprises, an adjustable control arm, a chain connected to the end of said control arm at one end thereof and the pad at its other end, said adjustable control arm extending from said cam actuated slide plate and movable in response to movement of said cam actuated slide plate, additional cam means carried by said head and stationary with respect to said head, and a cam follower engaging said additional cam means and mounted on said control arm for controlling the amount of rotation of the pad in response to movement of said cam actuated slide plate.

* * * * *